United States Patent [19]

Bost, Jr.

[11] Patent Number: 4,469,037

[45] Date of Patent: Sep. 4, 1984

[54] METHOD OF PRODUCING FOR REVIEW A TUFTED FABRIC PATTERN

[75] Inventor: Ralph H. Bost, Jr., Columbia, S.C.

[73] Assignee: Allied Corporation, Morris Township, Morris County, N.J.

[21] Appl. No.: 371,382

[22] Filed: Apr. 23, 1982

[51] Int. Cl.[3] ..... D05C 15/04

[52] U.S. Cl. ..... 112/266.2; 112/79 A

[58] Field of Search ..... 112/266.2, 266.1, 79 A, 112/79 R, 262.1, 158 E, 121.11, 121.12; 364/900

[56] References Cited

U.S. PATENT DOCUMENTS

| | | | |
|---|---|---|---|
| 2,654,288 | 10/1953 | Savadelis . | |
| 3,741,139 | 6/1973 | Frentress . | |
| 3,895,355 | 7/1975 | Shorrock | 112/79 A X |
| 3,925,776 | 12/1975 | Swallow . | |
| 3,944,997 | 3/1976 | Swallow . | |
| 4,078,253 | 3/1978 | Kajiura et al. . | |
| 4,106,416 | 8/1978 | Blackstone, Jr. et al. . | |
| 4,173,192 | 11/1979 | Schmidt et al. | 112/79 A X |
| 4,188,893 | 2/1980 | Shimazaki | 112/158 E X |
| 4,232,374 | 11/1980 | Chung et al. . | |
| 4,237,802 | 12/1980 | Scott | 112/266.2 X |
| 4,250,522 | 2/1981 | Seki et al. . | |
| 4,303,912 | 12/1981 | Stafford et al. . | |
| 4,303,986 | 12/1981 | Lans . | |

OTHER PUBLICATIONS

Infotex, International Carpet Bulletin, "Visual Tufting Aid Design", Jan. 1982, pp. 1, 5.

Infotex, International Carpet Bulletin, "More Details of the Tufting Stitch Pattern Simulation System", Apr. 1982, p. 2.

*Primary Examiner*—Peter P. Nerbun

[57] ABSTRACT

A method of producing for review a tufted fabric pattern prior to actually tufting the fabric with a tufting device is provided. The method comprises the steps of:

a. converting specified tufting parameters into a plurality of digital patterns;

b. converting the digital patterns into a plurality of video signals; and c. displaying the resultant graphics on a cathode-ray tube means.

Variations in tufting parameters can be easily and rapidly screened to determine if a desirable pattern emerges, thereby accelerating the development of marketable tufted fabric patterns.

4 Claims, 1 Drawing Figure

METHOD OF PRODUCING FOR REVIEW A TUFTED FABRIC PATTERN

BACKGROUND OF THE INVENTION

1. Field of the Invention

This invention relates to a method of producing for review a tufted fabric pattern prior to actually tufting the fabric with a conventional tufting device that utilizes either a staggered needle bar or multiple needle bars. Through use of an inexpensive microprocessor and a computer program, the designing of fabrics can be greatly accelerated. In lieu of running the actual graphics tufter, one can key basic tufting parameters into the computer. The invention provides a rapid, simple and inexpensive method of developing patterns for tufting.

2. The Prior Art

Conventional tufting machines generally utilize either a staggered needle bar or multiple, non-staggered needle bars. (A staggered needle bar is shown, for example, in U.S. Pat. No. 4,003,321 to Card, hereby incorporated by reference). A plan view of a staggered needle bar would show two straight parallel rows of needles with the needles being equispaced in each row but staggered in one row with respect to the other. The arrangement can also be viewed as having a needle at each apex and juncture of a plurality of contiguous V's. The non-staggered needle bars, on the other hand, support a plurality of needles, linearly arranged and usually equispaced. In the non-staggered needle bar, the gauge is the distance between adjacent needles; the gauge for a staggered needle bar, however, is normally one-half the distance between adjacent needles of one row. Heretofore, in order to determine the desirability of a particular tufted fabric pattern when using two or more non-staggered needle bars, it has been necessary to actually tuft the fabric or else use a graph paper plotting technique. Sample production is both time-consuming and expensive. Furthermore, little or no indication can be obtained by tufting a fabric pattern as to what changes in the tufting parameters would be advisable for improvement. It would be of great value to the industry to be able to develop designs and screen them prior to actually tufting.

U.S. Pat. No. 4,078,253 to Toshihiro et al. claims a pattern generating system for providing pattern information to produce a Jacquard pattern for a knitting or weaving machine. A pattern drawn on a sheet is converted to an analog signal by television camera. A digital signal is derived according to each color of the pattern. The digital signal is fed to a knitting or weaving machine to produce the pattern. A cathode-ray tube can be used to view the pattern.

Jacquard devices are much more complex than carpet tufting devices. In a Jacquard device, each yarn can be positioned almost independently of the others. Because of this, nearly any visible pattern can be simulated in a fabric produced by these devices. The carpet tufting devices are much more primitive from a patterning point of view, and most visual patterns cannot be duplicated.

U.S. Pat. No. 2,654,288 to Savadelis discloses the concept of correlating yarns and the appearance of a fabric woven from the yarns by viewing the pattern on a cathode-ray tube before weaving.

Additional patents of interest include U.S. Pat. Nos. 3,925,776 to Swallow, 3,944,997 to Swallow, 4,106,416 to Blackstone et al., 4,250,522 to Seki et al., and 4,303,986 to Lans. All of the patents mentioned above are hereby incorporated by reference.

SUMMARY OF THE INVENTION

The present invention provides a method of producing for review a tufted fabric pattern prior to actually tufting the fabric with a tufting device comprising at least two needle bars. The method comprises the steps of:

a. converting the tufting parameters of: a cam pattern for each of the needle bars, a cam phase, a creel pattern for each of the needle bars, and a creel phase into a plurality of digital patterns;
b. converting the digital patterns into a plurality of video signals; and
c. displaying the resultant graphics on a cathode-ray tube means.

It is preferred that the video signal be a frequency modulation video signal.

The present invention alternately provides a method of producing for review a tufted fabric pattern prior to actually tufting the fabric with a tufting device comprising a staggered needle bar. The method comprises the steps of:

a. converting the tufting parameters of: a stitch rate, a cam pattern for the staggered needle bar, and a creel pattern for the staggered needle bar into a plurality of digital patterns;
b. converting the digital patterns into a plurality of video signals; and
c. displaying the resultant graphics on a cathode-ray tube means.

It is preferred that the video signal be a frequency modulation video signal. It is conventional to use a graphics tufting machine which utilizes a Hydrashift device to shift multiple needle bars when tufting carpet fabric. The Hydrashift is a hydraulic device manufactured by Tuftco Corporation, Chatanooga, Tenn. A mechanical shifting device would be equally suitable. Shifting devices are also known for use with staggered needle bars.

The cam pattern is the number of stitches prior to each needle bar shift and the direction of each shift per pattern repeat. The cam phase is the relative position of the two shifting patterns with respect to each other. The creel pattern is the order of colors of yarn per repeat. The creel phase is the relative position of the yarns when the tufting device is at the center position of the shift. The stitch rate is the vertical distance traveled by the needle between successive tufts. The computer utilized in Example 1 is the Radio Shack Extended Color BASIC TRS-80 Computer. Microprocessor: 6809E 8-bit processor. Clock Speed: 0.894 MHz. Keyboard: 53-keys including up, down, right, left, arrows, BREAK and CLEAR. Video Display: 16 lines of 32 upper case characters. Color graphics capability is four colors to 128×96. Extended color BASIC, 16K RAM. Output connects directly to any standard color TV set (300 ohms) and includes video and sound. Memory: 16K internal dynamic RAM. Color BASIC is in 16K ROM for Extended Color BASIC. Input/output: 1500 baud cassette recorder. Power: 120VAC, 60 Hz, less than 50 W. Dimensions: $3\frac{1}{2}\times13\frac{3}{4}\times14\frac{3}{4}$ inches. The converter is standard with the computer. The television set utilized is a Sears 19-inch portable color TV, Model No. 564.42161700 series. The cassette recorder is by Radio Shack, CTR-80A, Catalog No. 26-1206, and includes a connecting cable. The computer utilized in Example 2 is the Radio Shack TRS-80 Model I. Microprocessor: Advanced Z-80 8-bit processor. Clock Speed, 1.78 MHz. Keyboard: Full-size "typewriter" style. 65-key integral keyboard includes 12-key numeric pad for data entry. Video display: Memory mapped with high-resolution 12-inch monitor. Includes 96 text characters, 64 graphics characters and 160 "special" characters. Screen format is 64 characters by 16 lines. Memory: Includes 4K or 12K ROM and 4K or 16K RAM. Input-/Output: Computer-controlled cassette interface standard, 500 Baud. Power: Integral power supply; 105–130 VAC, 60 Hz, U.L. listed. Dimensions: $12\frac{1}{2}\times18\frac{7}{8}\times21\frac{1}{2}$ inches. Monitor displays back and white. Cassette recorder as described above.

DESCRIPTION OF THE PREFERRED EMBODIMENT

Figure 1:
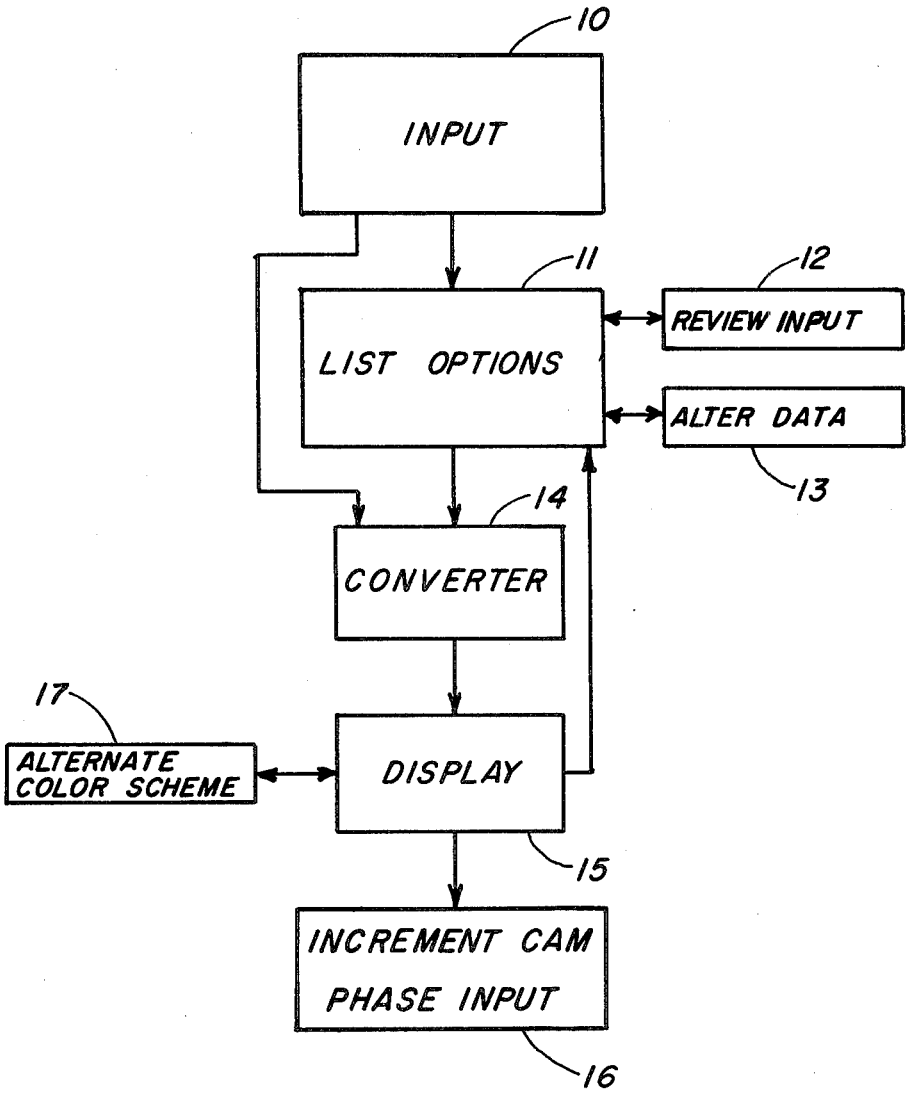
FIG. 1 illustrates information flow (by program) in a block schematic diagram.

The program (see Examples 1 and 2) is keyed into the computer via the keyboard and is stored in the RAM until power to the machine is interrupted. Radio Shack interfaces the above-referenced cassette recorder with the computers so that the software can be stored on the cassette recorder prior to interrupting power to the machine, and the program is reentered after power is again supplied; this obviates the need to enter the program each time the machine is used.

Relevent tufting parameters are keyed 10 into the computer after the program is entered. For the multiple needle bar embodiment (see Example 1 below), the cam patterns, cam phases(s), creel patterns and creel phase(s) are entered. For the staggered needle bar embodiment (see Example 2 below), the stitch rate, cam pattern and creel pattern are entered. This information exists as a plurality of digital patterns. The digital patterns are converted 14 into a plurality of video signals via an interface (which comes with the computer) to the monitor/television set. The video signal is a frequency modulation video signal. The tufted fabric pattern is displayed (see 15) on the monitor/television set.

EXAMPLE 1

In this example, a program was devised for reviewing a tufted fabric pattern which would be made with a tufting device comprising at least two needle bars. A square stitch rate, i.e., a stitch rate identical to the gauge or distance between needles, has been assumed. The program is as follows:

```
10  POKE 64595,0
20  PCLEAR 4
25  DIM V(4,188)
30  DIM A(20)
40  DIM B(20)
50  DIM C(27)
60  DIM D(27)
61  B$="02L8AB-P64B-L4RL8FL4G"
62  G$="02L4F03L2DL4EDL2C02L4.F"
63  H$="02L4F03L2DL4EDL2CL4.F"
64  C$="L4..AP4"
65  D$="L2F"
66  X$=G$+B$+C$+H$+B$+D$
70  CLS
80  PRINT "ANSO GRAPHICS PATTERNS":PRINT
90  PRINT "ENTER THE CAM PATTERN FOR THE
    FIRST NEEDLE BAR (EXAMPLE - 2,2,2,2,-2,-2,
    -2,-2)"
100 FOR Q=0 TO 27:INPUT D(Q)
110 IF D(Q)=0 THEN Q=27
120 NEXT
130 IF SS=1 THEN 810
140 PRINT "ENTER CAM PATTERN FOR SECOND
    NEEDLE BAR - EX (-2,-2,-2,-2,2,2,2,2)
150 FOR Q=0 TO 27:INPUT C(Q):IF C(Q)=0 THEN
    Q=27
160 NEXT
170 IF SS=1 THEN 810
180 INPUT "ENTER CAM PHASE INDICATOR
    (0,1,2,3 . . .)"; QQ:PRINT
190 IF SS=1 THEN 810
200 PRINT "ENTER CREEL PATTERN FOR FIRST
    NEEDLE BAR (COLORS 1 THRU 4)"
210 FOR Q=0 TO 20:INPUT B(Q):IF B(Q)=0 THEN
    Q=20
220 NEXT
230 IF SS=1 THEN 810
240 PRINT "ENTER CREEL PATTERN FOR SECOND
    NEEDLE BAR (COLORS 1 THRU 4)"
250 FOR Q=0 TO 20:INPUT A(Q):IF A(Q)=0 THEN
    Q=20
260 NEXT
270 IF SS=1 THEN 810
280 PRINT "ENTER CREELING PHASE INDICATOR
    (1,2,3 . . .)":INPUT RR
290 IF SS=1 THEN 810
300 GOTO 810
310 SS=0:PMODE 1,1:PCLS 1:SCREEN 1,0:G=2
320 P =-80
321 L =-84+8*RR
330 FOR A1=0 TO 20:X=B(A1):GOSUB 470:NEXT
350 FOR Q=0 TO 20:X=A(Q):GOSUB 410:NEXT:END
360 FOR A2=0 to 27:Z=C(A2):GOSUB
    530:NEXT:RETURN
378 GOTO 350
380 REM
390 FOR A3=0 TO 27:Z=D(A3):GOSUB
    530:NEXT:RETURN
400 IF Z=0 THEN 380
410 IF X=0 THEN Q=-1:RETURN
420 P=P+8
430 IF P>=335 GOTO 1000
440 IF X=1 THEN RETURN
450 N=P:R=0:GOSUB 360
460 RETURN
470 IF X=0 THEN A1=-1:RETURN
480 L=L+8
490 IF L>=335 THEN A1=20:RETURN
500 IF X=1 THENRETURN
510 N=L:R=-4*QQ:GOSUB 380
520 RETURN
530 IF Z=0 THEN A2=-1:A3=-1:RETURN
540 IF R>191 THEN A2=27:A3=27:RETURN
550 IF Z>0 THEN N=N+8
560 IF Z<0 THEN N=N-8
570 GOSUB 760
580 IF Z=1 OR Z=-1 THEN RETURN
590 GOSUB 760
600 IF Z=2 OR Z=-2 THEN RETURN
610 GOSUB 760
620 IF Z=3 OR Z=-3 THEN RETURN
630 GOSUB 760
640 IF Z=4 OR Z=-4 THENRETURN
650 GOSUB 760
660 IF Z=5 or Z=-5 THEN RETURN
670 GOSUB 760
680 IF Z=6 OR Z=-6 THEN RETURN
690 GOSUB 760
700 RETURN
710 REM
720 REM
730 REM
740 REM
750 RETURN
760 R=R+4
770 A$=INKEY$:IF A$<>"" THEN 810
780 IF R>-1 AND R<192 THEN 790 ELSE 800
790 IF N>-1 and N<256 THEN
    PSET(N,R,X):PSET(N+2,R,X):
```

-continued

```
      PSET(N,R+2,X):PSET(N+2,R+2,X)
800   RETURN
810   CLS:P=0:L=0:W=0:PRINT "OPTIONS:(1)LIST,
      (2)CAM PHASE, (3)CREEL PHASE, (4)CREEL 1st
      BAR(5)CREEL 2ND BAR, (6)CAM 1ST BAR(7)CAM
      2ND BAR, (8)PRINT PATTERN
820   INPUT W
830   SS=1:IF W=0 or W>8 THEN PRINT "NOT AN
      OPTION":PRINT:GOTO 810
840   ON W GOTO 850,180,280,200,240,90,140,310
850   PRINT "CAM 1ST BAR:";:FOR Q=0 TO 27:PRINT
      D(Q);:NEXT
860   PRINT "CAM 2ND BAR:";:FOR Q=0 TO 27:PRINT
      C(Q);:NEXT
870   PRINT "CREEL 1ST BAR:";:FOR Q=0 TO 20:PRINT
      B(Q);:NEXT:PRINT
880   PRINT "CREEL 2ND BAR:";:FOR Q=0 TO 20:PRINT
      A(Q);:NEXT:PRINT
890   PRINT "CAM PHASE INDICATOR="QQ
900   PRINT "CREELING PHASE INDICATOR="RR
910   INPUT "PRESS ENTER TO RETURN TO
      OPTIONS";A$
920   GOTO 810
930   GOTO 930
1000  SOUND100,10
1010  A$=INKEY$:IF A$=""THEN V=1-V:SCREEN
      1,V
1020  IF A$="O" THEN 810

1021  IF A$="^" THEN 1040

1030  GOTO 1010
1040  QQ=QQ+1:REM THIS PART OF THE PROGRAM

      INCREASES THE CAM PHASE WHEN ^ IS

      DEPRESSED.
1041  FOR T=248 TO OSTEP -8
1042  GET (T,0)-(T+4,188),V,G
1044  PUT (T,4)-(T+4,192),V,PSET
1046  NEXT
1079  GOTO 1010
```

Enter program via cassette tape player as on pages 71–75 of Radio Shack user's manual, Getting Started with Color Basic, TRS-80 TM Color Computer, 1981, hereby incorporated by reference. Before typing RUN, ask for a listing (LIST). If program properly lists, then type RUN. After RUN statement has been typed, "ANSO Graphics Patterns" should appear. Note that ANSO is a registered trademark of Allied Corporation for continuous filament and staple fiber.

Enter cam pattern for the first needle bar. The magnitude of the integer entered is the number of stitches prior to a needle bar shift. The sign +/− of the integer represents the directon of shift. "+" equals a shift to the right and "−" a shift to the left. The positive is assumed as long as a negative value is not entered.

i. Type the first desired integer, then press ENTER.
ii. Type the second desired integer, press ENTER again.
iii. Continue the above until the last integer has been entered. There is a program limit, by choice, of twenty-eight entries. Press the ENTER key again to proceed to the next step.

Cam pattern for the second needle bar. This information is entered exactly as for the previous bar. For geometric patterns, the second needle bar cam pattern can be the mirror image of the cam pattern used on the first needle bar. An example of opposite cam patterns would be:

| | | | | | | |
|---|---|---|---|---|---|---|
| Cam Pattern 1: | 2 | 2 | 1 | −1 | −2 | −2 |
| Cam Pattern 2: | −2 | −2 | −1 | 1 | 2 | 2 |

Enter cam phase. Cam phase is the relative position of the two shifting patterns with respect to each other. The cam phase value can be any positive or negative integer. If the two cam patterns start with integers of the same sign (+/−), a cam phase of zero lines them up. If however, the two cam patterns begin with integers of opposite signs, a cam phase of −2 is required to line them up.

Example if both are positive,

| | | | | |
|---|---|---|---|---|
| Cam Pattern 1: | 2 | 2 | −2 | −2 |
| Cam Pattern 2: | 2 | 2 | −2 | −2 |

use cam phase=0 for initial line up.

If one is positive, the other negative,

| | | | | |
|---|---|---|---|---|
| Cam Pattern 1: | 2 | 2 | −2 | −2 |
| Cam Pattern 2: | −2 | −2 | 2 | 2 |

use cam phase=−2 for initial line up.

Enter creel pattern for first needle bar. Although on the actual tufting device, the same creel feeds both needle bars, for style development it is advantageous to distinguish between yarns fed to one bar versus those fed to the other needle bar. Thus, the total creel plant is broken into three descriptive elements: (1) yarns fed to the first bar, (2) yarns fed to the second bar, and (3) relative position of the yarns when the tufting device is at the center position of the shift (equals "creel phase"). Each integer represents a different color. Only four colors are available with this equipment, so integers 1 through 4 are used. When the creel repeat (for example) for the first needle bar is 1,1,2,2, the needles on the first bar will be threaded with this repeat: Color 1, color 1, color 2, color 2, color 1, color 1, color 2, color 2 . . . . The needles in the second bar alternate with colors 1 and 2. If a creel phase of zero is used, the total creel repeat would be 1,1,1,2,2,1,2,2. If a creel phase of 1 is used, the yarns feeding to the first bar will all have been shifted one needle to the right. This changes the creel pattern to 1,2,1,1,2,2,2,1.

Data is entered as follows. Type color integer for first color, press enter. Type integer for second color, press enter. Continue until total repeat of a single bar has been entered. The program limit, by choice, is twenty-one entries. Press enter again to proceed to next question.

Enter creel pattern for second needle bar. Information entered as on first needle bar.

Enter creel phase, described previously.

If all the data entered 10 in the first part of the program is correct, it is possible to proceed directly to the "print pattern" or display 15 option. To check the data previously entered, use the "list" 11 option. To select an option, simply type the integer that represents the option and press enter. This causes the program to proceed to that option 12. If bad data has been entered, the various options allow the change of any one description 13 (e.g., cam pattern of first bar) without changing the others. The original data is eliminated and new data can be entered.

Once all data is satisfactory, type the integer for the "print pattern" option, then press enter. The screen should clear itself, then in a few moments, the pattern will begin printing on the screen. First printed are the yarns to be placed by the first needle bar. After the screen is filled with yarns placed by the first bar, there will be a fairly long pause, then tufts placed by the second needle bar will be overlaid on the display. This pause is due to the calculation of points not pictured on the screen.

After the pattern has been completely printed, there are several options:

(1) Cam phase. To change the cam phase without going back to the option program and waiting the 2–3 minutes for a reprint, increment 16 the cam phase one unit at a time by pressing the up arrow key. The phase is incremented both on the screen and in the listing. Part of the pattern along one edge is lost during this procedure, but if a meaningful pattern is discovered, then a return to the option program will allow a clean reprint of the full screen.

(2) Return to Option. Simply type the letter "O". The screen will be deleted and the options reappear where changes can be made and then the "print pattern" option repeated.

(3) Alter Color Scheme. In the degree of resolution at which this program was written, there are two distinct 4-color schemes. To change to the alternate scheme 17 and back, depress the space bar.

EXAMPLE 2

In this example, a program was devised for reviewing a tufted fabric pattern which would be made with a tufting device comprising a single, staggered needle bar. The program is as follows:

```
10 CLS
20 Clear
30 Print "Hydrashift Patterns"
40 Print "Enter Cam Pattern"
50 Input C0,C1,C2 . . . C7
60 Print "Enter Creel Pattern for 1st Needle Row"
70 Input B0,B1,B2 . . . B9
80 Print "Enter Creel Pattern for 2nd Needle Row"
90 Input A0,A1,A2 . . . A9
92 Print "Enter Creeling Phase Indicator"
93 Input BB
100 Print "Enter Stitch Rate" (1 for SR=10.3, 2 for SR =
    5.13, 3 for SR=7.7)
101 Input D
102 E=D:If D=3 then D=2
103 If D=1 then E=2
111 CLS
119 P=-40
120 X=A0:GOSUB 1000
121 X=A1:GOSUB 1000
122 X=A2:GOSUB 1000
123 X=A3:GOSUB 1000
124 X=A4:GOSUB 1000
125 X=A5:GOSUB 1000
126 X=A6:GOSUB 1000
127 X=A7:GOSUB 1000
128 X=A8:GOSUB 1000
129 X=A9:GOSUB 1000
139 L=-44
140 X=B0:GOSUB 1100
141 X=B1:GOSUB 1100
142 X=B2:GOSUB 1100
143 X=B3:GOSUB 1100
144 X=B4:GOSUB 1100
145 X=B5:GOSUB 1100
146 X=B6:GOSUB 1100
147 X=B7:GOSUB 1100
148 X=B8:GOSUB 1100
149 X=B9:GOSUB 1100
229 Z=CO:GOSUB 1200
230 If R>47 Return
```

-continued

```
231 Z=C1:GOSUB 1200
232 Z=C2:GOSUB 1200
233 Z=C3:GOSUB 1200
234 Z=C4:GOSUB 1200
235 Z=C5:GOSUB 1200
236 Z=C6:GOSUB 1200
237 Z=C7:GOSUB 1200
238 Z=C8:GOSUB 1200
239 GOTO 229
1000 If X=0 GOTO 120
1010 P=P+8
1020 If P>=167 GOTO 139
1040 Q=P:R=0 GOSUB 229
1030 If X=2 Return
1050 Return
1100 If X=0 GOTO 140
1110 L=L+8
1120 If P>=167 GOTO 139
1130 If X=2 Return
1140 Q=L:R=E:GOSUB 229
1150 Return
1200 If Z=0 GOTO 229
1201 If R>47 Return
1210 If Z>0 then Q=Q+8
1220 If Z<0 then Q=Q-8
1230 GOSUB 1382
1260 If Z=1 or Z=-1 Return
1270 GOSUB 1382
1300 If Z=2 or Z=-2 Return
1310 GOSUB 1382
1340 If Z=3 or Z=-3 Return
1350 GOSUB 1382
1380 Return
1382 R=R+D
1385 If R>-1 and R<48 then 1386 else 1387
1386 If Q>-1 and Q<127 Set (Q,R):Set(Q+1,R)
1387 Return
1400 GOTO 1400
```

The program may be keyed in or entered via cassette player as in Example 1. The entries for cam pattern (up to 8 entries), creel pattern for first needle bar (up to 10 entries for front row of needles on staggered needle bar), and creel pattern for second needle bar (up to 10 entries for rear row of needles on staggered needle bar), creel phase are entered as in Example 1. Thereafter, the stitch rate is entered as either 1, 2 or 3 where 1=10.3, 2=5.13 and 3=7.7 stitches per inch.

I claim:

1. A method of producing for review a tufted fabric pattern prior to actually tufting the fabric with a tufting device comprising at least two needle bars, comprising the steps of:

a. converting the tufting parameters of: a cam pattern for each of the needle bars, a cam phase, a creel pattern for each of the needle bars, and a creel phase, into a plurality of digital patterns;

b. converting the digital patterns into a plurality of video signals; and c. displaying the resultant graphics on a cathode-ray tube means.

2. The method of claim 1 wherein the video signal is a frequency modulation video signal.

3. A method of producing for review a tufted fabric pattern prior to actually tufting the fabric with a tufting device comprising a staggered needle bar, comprising the steps of:

a. converting the tufting parameters of: a stitch rate, a cam pattern for the staggered needle bar, and a creel pattern for the staggered needle bar, into a plurality of digital patterns;

b. converting the digital patterns into a plurality of video signals; and c. displaying the resultant graphics on a cathode-ray tube means.

4. The method of claim 3 wherein the video signal is a frequency modulation video signal.

* * * * *